United States Patent [19]

Gateley

[11] Patent Number: 4,995,144

[45] Date of Patent: Feb. 26, 1991

[54] CONNECTOR

[75] Inventor: Martin F. Gateley, Kings Langley, England

[73] Assignee: Systemworks Limited, Hertfordshire, England

[21] Appl. No.: 414,028

[22] Filed: Sep. 28, 1989

[30] Foreign Application Priority Data

Sep. 29, 1988 [GB] United Kingdom ..... 8822880

[51] Int. Cl.[5] ..... E05D 7/00

[52] U.S. Cl. ..... 16/261; 16/270; 16/366; 16/368; 16/387; 160/135; 160/229.1

[58] Field of Search ..... 16/226, 228, 229, 368, 16/369, 370, 243, 248, 261, 262, 265, 270, DIG. 13, 227, 366, 387; 211/195, 169; 160/229.1, 135

[56] References Cited

U.S. PATENT DOCUMENTS

| | | | |
|---|---|---|---|
| 3,201,821 | 8/1965 | Ruckstuhl | 16/366 |
| 3,696,855 | 10/1972 | Kira | 160/135 |
| 4,232,724 | 10/1980 | Brown | 160/135 |
| 4,610,560 | 9/1986 | Miller | 160/229.1 |
| 4,644,992 | 2/1987 | Jerila | 16/DIG. 13 |
| 4,684,017 | 8/1987 | Watanabe et al. | 16/265 |
| 4,785,565 | 11/1988 | Kuffner | 160/135 |
| 4,807,329 | 2/1989 | Mossalgne | 16/DIG. 13 |

FOREIGN PATENT DOCUMENTS

| | | | |
|---|---|---|---|
| 664594 | 6/1963 | Canada | 16/350 |
| 2253809 | 5/1974 | Fed. Rep. of Germany | 16/353 |
| 2563098 | 10/1985 | France | 160/135 |
| WO84/011-82A1 | 3/1984 | PCT Int'l Appl. . | |
| 858835 | 1/1961 | United Kingdom . | |
| 1059309 | 2/1967 | United Kingdom . | |
| 1119172 | 7/1968 | United Kingdom . | |
| 1536951 | 12/1978 | United Kingdom . | |
| 2099910 | 12/1982 | United Kingdom . | |
| 2101202 | 1/1983 | United Kingdom | 16/265 |

*Primary Examiner*—Richard K. Seidel
*Assistant Examiner*—Edward A. Brown
*Attorney, Agent, or Firm*—Nixon & Vanderhye

[57] ABSTRACT

A connector is provided for hingedly connecting two substantially identical, elongate profile members together. These profile members define the rigid peripheries or frames of freestanding display panels or screens. Each connector comprises two link members, each having an elongate web carrying two spaced pivot pins, and two connecting parts. Each connecting part is either constituted by, or has the same profile, as a profile member. The connector enables the two profile members to be pivoted between a facing position and a side by side position. In one of these positions the two link members extend parallel to one another, while in the other of these positions, the two link members cross relative to one another.

12 Claims, 2 Drawing Sheets

CONNECTOR

BACKGROUND TO THE INVENTION

The present invention relates to a connector and to an assembly comprising two elongate profile members connected together by two or more such connectors.

It is known to produce freestanding panels or screens having rigid peripheries or frames defined by extruded profile members made, for example, in aluminium or plastics material. Such panels and screens can be interconnected as required to produce a display.

There is a need to selectively hinge such display panels and screens together. However, not only must the hinges be sufficiently robust, the construction of the profile members and the hinges should be kept as simple as possible. Furthermore, it is often required that the hinges should be removable.

SUMMARY OF THE INVENTION

According to a first aspect of the present invention there is provided a connector comprising two substantially identical link members, each said link member comprising an elongate web having a first face carrying two spaced projections.

The connector is intended to hingedly connect two profile members, for example, extrusions for forming display panels, together and each projection of each link member is arranged to engage with a respective profile member. The panels can then extend in substantially the sam plane or, by hinged movement, be moved to extend in planes at an angle to one another.

Preferably, the second face of each elongate web is substantially planar. This enables two link members to be arranged with their second faces adjacent and with their projections projecting in opposite directions.

In an embodiment, each projection of each link member is a projecting pin, preferably a substantially cylindrical pin. Each said pin is preferably at or near a respective end of said elongate web.

The invention also extends to a connector comprising two connecting parts and link means connecting said parts for movement about a longitudinal hinge axis between a first position in which a transverse axis of each part extends in a common plane containing said hinge axis, and a second position in which the transverse axes of the two parts are substantially parallel and are on opposite sides of said hinge axis, wherein said link means comprise two elongate link members each extending between and coupling the two parts, said link members being arranged to extend substantially parallel in one of said first and second positions, and to cross relative to each other in the other of said first and second positions.

In a preferred embodiment, said link members cross relative to one another in said first position of the connecting parts and extend substantially parallel to each other in said second position.

In an embodiment, each link member is pivotably connected to each said part, for example, by way of a respective pivot pin. In one embodiment, each pivot pin is located at or near an end of the link member and is received within a respective bore or recess of the connecting part.

The connector is particularly intended for hingedly connecting two profile members, for example, in the form of extrusions for forming display panels, together. In one embodiment the two connecting parts are constituted by the profile members and are connected together at their ends by the two link members.

Generally, the two profile members are sufficiently long that it is not sufficient to connect them by a single connector. In this event each profile member may be divided into two or more lengths, to hingedly connect each pair of corresponding lengths of the two members by way of two link members, and to connect the lengths of each profile member.

Additionally and/or alternatively, two profile members can be connected by two or more connectors as defined above, the two connecting parts of each connector being connected to a respective profile member.

In one embodiment, each connecting part is arranged to be fastened in a recess provided in the respective profile member. Alternatively, each connecting part is arranged to have a profile substantially the same as that of said profile member and is connected to said profile member to form an extension thereof.

Each said link member preferably comprises an elongate web having a first face carrying two spaced, projecting pins and a substantially planar second face. In one embodiment, the two link members are arranged with their second faces adjacent and with their pins projecting substantially longitudinally in opposite directions away from one another. The link members extend into the connecting parts and their pins are received in appropriate bores or recesses in the connecting parts. In an alternative embodiment, the two link members are longitudinally spaced and are arranged at opposite ends of said connecting parts. In this embodiment, the pins of the two link members project substantially longitudinally in opposite directions towards one another.

The present invention also extends to an assembly comprising two profile members connected together by two or more connectors as defined above.

According to a further aspect of the present invention there is provided an assembly comprising two elongate profile members connected together by two or more connectors for movement about a longitudinal hinge axis between a first, facing position in which a transverse axis of each profile member extends in a common plane containing said hinge axis, and a second, side by side position, in which the transverse axes of the two profile members are substantially parallel and are on opposite sides of said hinge axis, wherein each said connector comprises two elongate link members each extending between and coupling the two profile members, said link members being arranged to extend substantially parallel in one of said first and second positions, and to cross relative to each other in the other of said first and second positions.

In a preferred embodiment, said link members cross relative to one another in said first position of the profile members and extend substantially parallel to each other in said second position.

The profile members may be used as supports and/or peripheral members of display panels, freestanding screens and the like.

Each connector may comprise two link members only, these link members directly connecting the two said profile members. For example, the profile members may be connected together by one connector, the two link members of the connector being longitudinally spaced and arranged at opposite ends of the profile members.

Where the two profile members are too long to be connected by a single connector, the two profile members may each be similarly divided into two or more lengths and one connector interposed between corresponding adjacent lengths of both profile members. Each link member then connects the end of one length of one profile member to the end of the corresponding length of the other profile member. Of course, in this situation it is also necessary to connect the two adjacent lengths of each profile member together.

In an embodiment each elongate profile member is provided with an elongate, longitudinally extending recess or cavity therein which is substantially uniform in cross-section. This enables lengths of the profile member to be fastened together by engaging a bar, rod or other elongate extension piece through the recess or cavity of each said length.

In an embodiment, the connectors further comprise two connecting parts hingedly connected by way of said link members. Each connecting part is connected to a respective profile member whereby the two profile members are in their turn hingedly connected together. In one embodiment, each connecting part comprises a substantially U-shaped bracket fastened into a corresponding recess provided in the respective profile member. One end of each of the link members is received within, and pivotably fastened to, the U-shaped bracket.

In a preferred embodiment, each link member is constructed as defined above.

BRIEF DESCRIPTION OF THE DRAWINGS

Embodiments of the present invention will hereinafter be described, by way of example, with reference to the accompanying drawings, in which.

DESCRIPTION OF PREFERRED EMBODIMENTS

Modern display systems are generally based on the interconnection of panels to form dividers, screens, walls and the like, and/or to carry shelves, work surfaces an the like. Naturally, it simplifies manufacture and keeps costs down if the number of individual parts can be kept as low as possible. It is known to form panels using metal, particularly aluminium, extrusions which are connected together to form frames arranged to support appropriate material. There is often a need to hingedly connect such panels together, but previous proposals for hinge members have not been entirely satisfactory.

Figure 1:
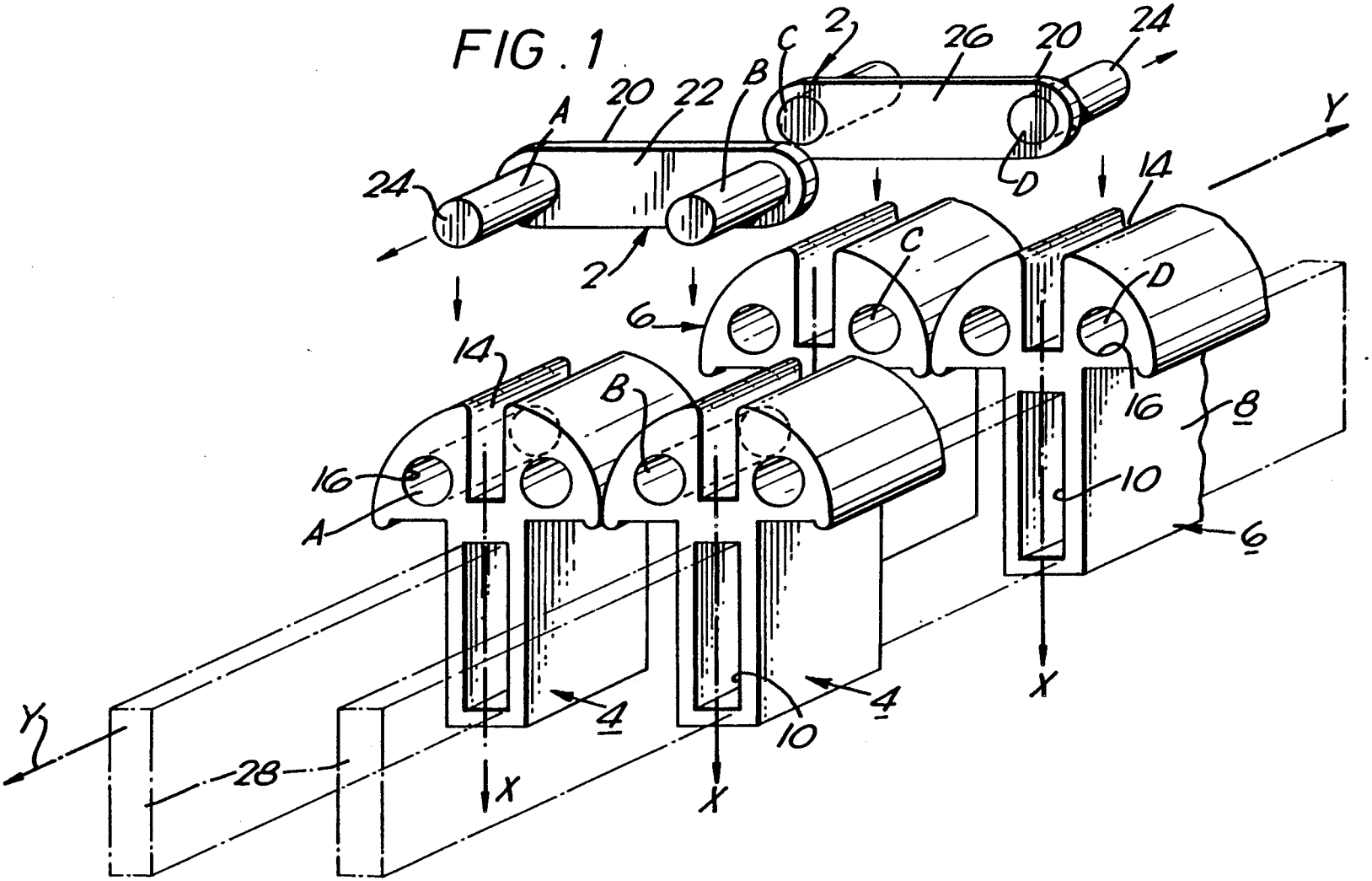
FIG. 1 shows an exploded view of link members and connecting parts of a connector of the present invention.

FIG. 1 schematically illustrates a connector for hingedly connecting two substantially identical, elongate profile members 6 together. Each of these profile members 6 is an extrusion and may be used to form the frame of a display panel. In the embodiment illustrated in FIG. 1 the connector comprises two link members 2 and two connecting parts 4. It will be seen that each of the connecting parts 4 is a relatively short length of the same extrusion as that forming the profile members 6. Thus, it will be appreciated that the connecting parts 4 each has a profile which is substantially the same as that of each of the profile members 6.

Each elongate profile member 6 has a body portion 8 which is substantially rectangular in transverse section and through which a substantially rectangular channel 10 extends. This body portion 8 supports a head portion 12 having a substantially semi-circular perimeter. A slot 14 with a substantially rectangular cross-section extends longitudinally along the head portion 12. Two circular cross-section bores 16 extend in the head portion 12 along the profile member 6.

As is made clear above, each connecting part 4 is preferably a short length of the same extrusion as that which forms the profile members 6. Accordingly, each connecting part 4 is similarly provided with a rectangular channel 10, a slot 14 and two through bores 16.

Each link member 2 comprises an elongate web 20 having a first face 22 carrying two spaced, substantially cylindrical, projecting pivot pins 24. The second face 26 of each link member 2 is substantially planar. The pins 24 are sized to enable their insertion into a respective bore 16. The spacing of the two pins 24 on a single link member 2 is arranged to be greater than the distance between the two bores 16 of a single profile member 6 or of a connecting part 4. It will be seen that each pin 24 is located near an end of the respective link member 2.

As is illustrated in FIG. 1, a respective bar 28, which is substantially rectangular in cross-section, is positioned to extend through the channels 10 of each profile member 6 and the adjacent connecting part 4. In this manner the profile member 6 and its corresponding connecting part 4 are aligned longitudinally such that each connecting part 4 effectively forms an extension of the respective profile member 6. One of the link members 2 is located such that its pins 24 are received in respective bores 16 of the two adjacent connecting parts 4. In this respect, the pins 24 of the one link member 2 indicated as "A" and "B" are received in the bores 16 of the connecting parts 4 correspondingly marked "A" and "B". Similarly, the pins 24 of the other link member 2 marked "C" and "D" are similarly received in the bores 16 correspondingly marked "C" and "D" of the two profile members 6.

In the embodiment shown in FIG. 1 the two profile members 6, and their extensions formed by the connecting parts 4, are positioned side by side to extend substantially parallel to one another. In this position, a transverse axis "X" of one profile member 6 extends substantially parallel to a corresponding transverse axis "X" of the other profile member 6. Similarly, the transverse axes of the two connecting parts 4 are substantially parallel. The connector is arranged to define a substantially longitudinally extending hinge axis "Y—Y" and it will be seen that the transverse axes "X" of the two adjacent profile members 6 are on opposite sides of this hinge axis "Y—Y". The transverse axes "X" of the connecting parts 4 are similarly on opposite sides of the hinge axis "Y—Y". In this position it will be seen that the elongate webs 20 of the two link members 2 extend substantially parallel to each other.

It will be appreciated that the two extended profile members 6 of FIG. 1 may be pivoted outwardly to a facing position in which, as shown in FIG. 1, each transverse axis "X" extends substantially horizontally. In this position the transverse axes "X" of each profile member 6 extend in a common plane which also contains the hinge axis "Y—Y". This position is obtained by pivoting movement of the profile members 6 and the connecting parts 4 about the pivot pins 24, and in the facing position the elongate webs 20 of the two link members 2 no longer extend substantially parallel but cross relative to one another. The facing position to which the profile members of FIG. 1 may be moved will be apparent from FIG. 2 which shows the profile members of a further embodiment of the invention in the facing position.

In the embodiment of FIG. 1, the ends of two adjacent profile members 6 are shown connected by a connector comprising two connecting parts 4 and two link members 2. Each connecting part 4 is connected to extend its respective profile member 6 by way of the bar 28. Preferably, the opposite end of each profile member 6 will be similarly extended by a respective connecting part 4 of a second connector (not shown) so that the two profile members 6 are hingedly connected together at both ends.

Figure 3:
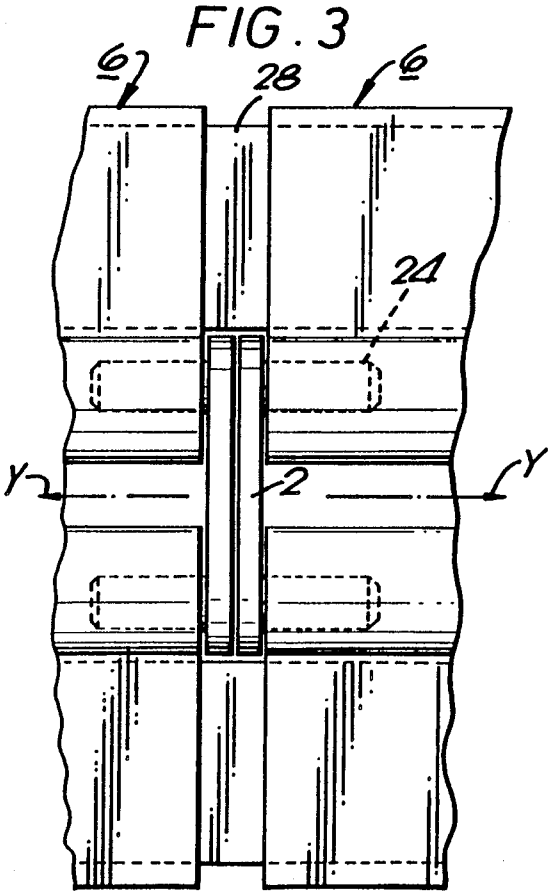
FIG. 3 shows a side view of the connected profile members of FIG. 2.
Figure 2:
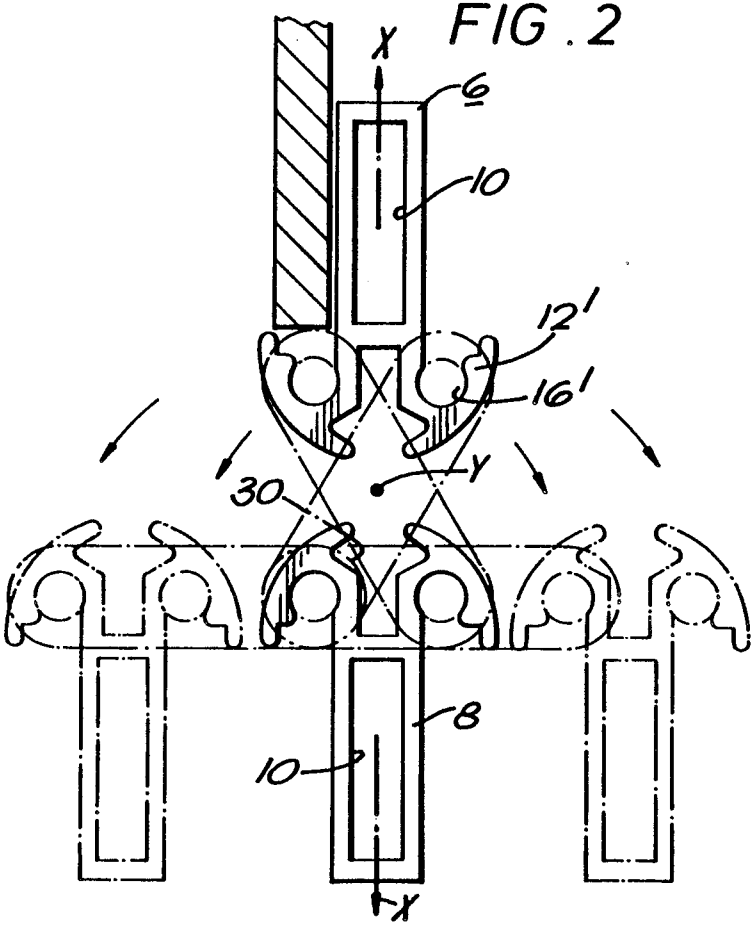
FIG. 2 shows a plan view of two profile members hingedly connected by a connector of the invention.

It will be appreciated that where each connecting part 4 is of the same extrusion as the profile members 6, it is not in fact necessary to provide specific, short connecting parts if not required. For example, the two elongate profile members which are to be hingedly connected together can each be identically divided into two or more separate lengths. Two link members as 2 can then be used to hingedly connect the two profile members at such a division with adjacent lengths of each profile member being connected by way of a bar 28 extending therethrough. FIGS. 2 and 3 illustrate an embodiment in which divided profile members 6 are connected by way of link members 2.

In the embodiment shown in FIGS. 2 and 3 each profile member 6 is divided into a number of separate lengths. Adjacent lengths of the same profile member 6 are joined by way of the bar 28 extending through the channel 10 thereof. A connector comprising two link members 2 joins the two profile members together at such a division in their length.

It will be seen from FIG. 2, which shows the two profile members 6 in their facing position with their transverse axes "X" aligned, that the transverse cross-section of the profile members 6 is slightly different to that of the embodiment of FIG. 1. The profile members 6 have the same rectangular body portion 8 with the elongate, rectangular transverse section channel 10 extending therethrough. However, the head portion 12' of each profile member has been further shaped such that substantially circular section channels 16' which open towards the body portion 8 have replaced the cylindrical bores 16. In addition, the rectangular slot 14 has been provided with additional shaping at 30 as it opens into the periphery of the head portion 12'. Of course, it will be appreciated that the exact transverse section shape of the extrusions will depend upon the use to which the extrusions are to be put and, for example, where the extrusions are being used in a display system shaping on the extrusions may be provided to co-operate with other elements of the display system.

In FIG. 2 the two profile members 6 are arranged in their facing position in which they extend substantially in a common plane, and in which their transverse axes "X" extend in a common plane which contains the hinge axis "Y". In this position the crossed relative position of the two link members 2 is apparent. FIG. 3 is a side view of the profile members 6 in their facing position of FIG. 2. The hinging of one profile member 6 about the axis "Y—Y" to the side by side position in which the one profile member extends substantially parallel to, and on one side or the other of the first profile member 6 is illustrated in dash-dot lines in FIG. 2. It will be appreciated that as one profile member is hinged to extend substantially parallel to the other the link members 2 are pivoted out of their position in which they are crossed relative to each other to their position in which they extend substantially parallel to each other. Of course, it will be appreciated that in all positions the two link members 2 are spaced in the longitudinal direction. In both embodiments illustrated the link members 2 are arranged back to back with their second faces 26 adjacent and with their pins 24 extending in opposite longitudinal directions.

In the embodiments illustrated corresponding lengths of the two profile members are connected by two link members 2. Thus, each profile member is effectively divided into a number of lengths with link members interposed therebetween. However, it may be required, for example for rigidity, that two single profile members which are undivided are hingedly connected. This can be achieved by providing a respective recess in the two profile members at substantially the same locations along the length of the profile members. A connecting part forming part of the connector is then fastened into each said recess and the two connecting parts are then hingedly connected by way of two link members. For example, each connecting part may comprise a substantially U-shaped bracket opening outwardly of the profile member in whose recess it is secured. Each arm of each said U-shaped bracket may be provided with a hole or bore into which a respective pin of a respective link member may engage.

In a further additional embodiment two connecting parts as 4 in FIG. 1 may be hingedly connected by two link members 2, the link members being located at opposite ends of the pair of connecting parts with their pins 24 extending towards one another. It will be appreciated that the connector so formed by the two connecting parts 4 and the two link members 2 will allowed hinged movement of the two connecting parts 4. Each connecting part 4 can then be located by way of a respective bar 28 to extend a respective profile member 6.

It will be appreciated that other variations and modifications of the invention as described and illustrated may be made within the scope of the present invention.

I claim:

1. A connector comprising two connecting parts each having a respective, substantially transversely extending axis passing through a central portion of said connecting part, and link means connecting said two connecting parts such that a substantially longitudinally extending hinge axis is defined, wherein said link means connects said parts for movement between a first position in which said substantially transverse axis of each said part extends in a common plane containing said hinge axis, and a second position in which said substantially transverse axes of said two parts are substantially parallel and are on opposite sides of said hinge axis, wherein said link means comprise two elongate link members, each said link member extending between and coupling said two parts, said link members being arranged to extend substantially parallel to one another in one of said first and second positions, and to cross relative to one another in the other of said first and second positions, and wherein the two connecting parts are constituted by two profile members which are connected together at one of their ends by said two link members.

2. An assembly comprising two elongate profile members connected together by at least one connector, said connector comprising two connecting parts each connected to a respective profile member and each having a respective, substantially transversely extending axis passing through a central portion of said connecting part, and link means connecting said two connecting parts such that a substantially longitudinally extending hinge axis is defined, wherein said link means connects said parts for movement between a first position in which said substantially transverse axis of each said part extends in a common plane containing said hinge axis, and a second position in which said substantially transverse axes of the said two parts are substantially parallel and are on opposite sides of said hinge axis, wherein said link means comprise two elongate link members, each said link member extending between and coupling said two parts, said link members being arranged to extend substantially parallel t one another in one of said first and second positions, and to cross relative to one another in the other of said first and second positions, and wherein each said connecting part is arranged to have a profile substantially the same as that of said profile member and is arranged to be connected to said profile member to form an extension thereof.

3. A connector comprising two connecting parts each having a respective, substantially transversely extending axis passing through a central portion of said connecting part, and link means connecting said two connecting parts such that a substantially longitudinally extending hinge axis is defined, wherein said link means connects said parts for movement between a first position in which said substantially transverse axis of each said parts extends in a common plane containing said hinge axis, and a second position in which said substantially transverse axis of the said two parts are substantially parallel and are on opposite sides of said hinge axis, wherein said link means comprise two elongate link members, each said link member extending between and coupling said two parts, said link members being arranged to extend substantially parallel to one another in one of said first and second positions, and to cross relative to one another in the other of said first and second positions, and wherein each said link member comprises an elongate web having a first face carrying two spaced, projecting pins and a substantially planar second face, said two link members being arranged with their second faces adjacent and with their pins projecting substantially longitudinally in opposite directions away from one another, the link members extending into the connecting parts with their pins being received in appropriate bores or recesses in the connecting parts.

4. A connector according to claim 3, wherein the two link members are longitudinally spaced and are arranged at opposite ends of said connecting parts, and wherein the pines of the two link members project substantially longitudinal in opposite directions towards one another.

5. An assembly comprising two elongate profile members connected together by two or more connectors for movement about a longitudinal hinge axis between a first, facing position in which a transverse axis of each profile member extends in a common plane containing said hinge axis, and a second, side by side position, in which the transverse axes of the two profile members are substantially parallel and are on opposite sides of said hinge axis, wherein each said connector comprises two elongate link members each extending between and coupling the two profile members, said link members being arranged to cross relative to each other at a central portion of each link member in said first position of the profile members, and to extend substantially parallel to each other in said second position, and wherein each said connector comprises two link members only, said two link members directly connecting the two said profile members.

6. An assembly according to claim 5, wherein said two profile members are each divided similarly into two or more lengths and one of said connectors is interposed between corresponding adjacent lengths of both profile members, each link member of said connector connecting the end of one length of one profile member to the end of the corresponding length of the other profile member.

7. An assembly according to claim 6, wherein each elongate profile member is provided with an elongate, longitudinally extending recess or cavity therein which is substantially uniform in cross-section.

8. An assembly according to claim 7, wherein lengths of the profile member are fastened together by engaging a bar, rod or other elongate extension piece through the recess or cavity of each said length.

9. An assembly comprising two elongate profile members connected together by two or more connectors for movement about a longitudinal hinge axis between a first, facing position in which a transverse axis of each said profile member extends in a common plane containing said hinge axis, and a second, side by side position, in which the transverse axes of the two profile members are substantially parallel and are on opposite sides of said hinge axis, wherein each said connector comprises two elongate link members each extending between and coupling the two profile members, said link members being arranged to cross relative to each other at a central portion of each link member in said first position of the profile members, and to extend substantially parallel to each other in said second position, wherein the connectors further comprise two connecting parts hingedly connected by way of said link members, each said connecting part being connected to a respective profile member whereby the two profile members are in their turn hingedly connected together, each said connecting part comprising a substantially U-shaped bracket fastened into a corresponding recess provided in the respective profile member, one end of each of the link members being received within, and pivotably fastened to, the U-shaped bracket, and wherein each said link member comprises an elongate web having a first face carrying two spaced, projecting pins and a substantially planar second face, the two link members being arranged with their second faces adjacent and with their pins projecting substantially longitudinally in opposite directions away from one another, the link members extending into the connecting parts with their pins being received in appropriate bores or recesses in the connecting parts.

10. An assembly according to claim 10, wherein the two link members are longitudinally spaced and are arranged at opposite ends of said connecting parts, and wherein the pins of the two link members project substantially longitudinally in opposite directions towards one another.

11. An assembly comprising two elongate profile members connected together by two or more connectors for movement about a longitudinal hinge axis between a first, facing position in which a transverse axis of each profile member extends in a common plane containing said hinge axis, and a second, side by side position, in which the transverse axes of the two profile members are substantially parallel and are on opposite sides of said hinge axis, wherein each said connector comprises two elongate link members each extending between and coupling the two profile members, said link members being arranged to extend substantially parallel in one of said first and second positions, and to cross relative to each other at a central portion of each link member in the other of said first and second positions, and wherein each said link member comprises an elongate web having a first face carrying two spaced, projecting pins and a substantially planar second face, and wherein the two link members are arranged with their second faces adjacent and with their pins projecting substantially longitudinally in opposite directions away from one another, the link members extending into the connecting parts with their pins being received in appropriate bores or recesses in the connecting parts.

12. An assembly comprising two elongate profile members connected together by two or more connectors for movement about a longitudinal hinge axis between a first, facing position in which a transverse axis of each profile member extends in a common plane containing said hinge axis, and a second, side by side position, in which the transverse axes of the two profile members are substantially parallel and are on opposite sides of said hinge axis, wherein each said connector comprises two elongate link members each extending between and coupling the two profile members, said link members being arranged to extend substantially parallel in one of said first and second positions, and to cross relative to each other at a central portion of each link member in the other of said first and second positions, and wherein each said link members comprise an elongate web having a first face carrying two spaced, projecting pins and a substantially planar second face, and wherein the two link members are longitudinally spaced and are arranged at opposite ends of said connecting parts, and wherein the pins of the two link members project substantially longitudinally in opposite directions towards one another.

* * * * *